US006797973B2

(12) United States Patent
Zens

(10) Patent No.: US 6,797,973 B2
(45) Date of Patent: Sep. 28, 2004

(54) UNIT DOSE SYRINGE SHIELD AND MEASURING APPLICATOR

(76) Inventor: Albert L. Zens, 3899 Sweet Rd., Jamesville, NY (US) 13078

( * ) Notice: Subject to any disclaimer, the term of this patent is extended or adjusted under 35 U.S.C. 154(b) by 72 days.

(21) Appl. No.: 10/401,183

(22) Filed: Mar. 27, 2003

(65) Prior Publication Data

US 2003/0226983 A1 Dec. 11, 2003

Related U.S. Application Data

(63) Continuation-in-part of application No. 10/241,418, filed on Sep. 11, 2002, which is a continuation-in-part of application No. 10/167,025, filed on Jun. 11, 2002, now Pat. No. 6,614,040.

(51) Int. Cl.[7] ..... G21F 5/018

(52) U.S. Cl. ..... 250/515.1; 250/506.1; 250/507.1; 206/364; 206/524.1; 53/449; 53/485; 220/23.87

(58) Field of Search ..... 250/515.1, 506.1, 250/507.1; 206/364, 524.1; 53/49, 585; 220/23.87

(56) References Cited

U.S. PATENT DOCUMENTS 6,576,918 B1 * 6/2003 Fu et al. ..... 250/507.1
6,614,040 B1 * 9/2003 Zens ..... 250/515.1

* cited by examiner

*Primary Examiner*—Keit T. Nguyen
(74) *Attorney, Agent, or Firm*—Michael P. Williams; Bond, Schoeneck & King, PLLC

(57) ABSTRACT

An apparatus that acts as a shield for radiopharmaceuticals and protects individuals from radioactivity includes a first body with a first hollow core, a second body with a second hollow core and a third body with a third hollow core. The first hollow core, second hollow core and third hollow core collectively house an insert. The insert houses a hypodermic syringe. A first connection means releasably communicates the first body with the second body. A second connection means releasably communicates the first body with the third body. The second body comprises a piston actuator. The piston actuator can be operated to depress the piston of the hypodermic syringe while the first body is in communication with the second body, and while the third body is removed.

18 Claims, 5 Drawing Sheets

Fig. 10
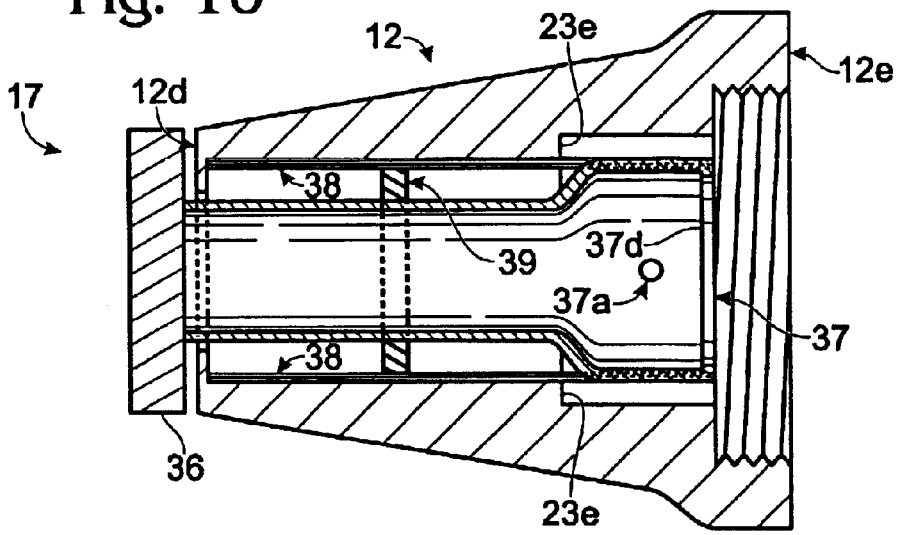
Fig. 11
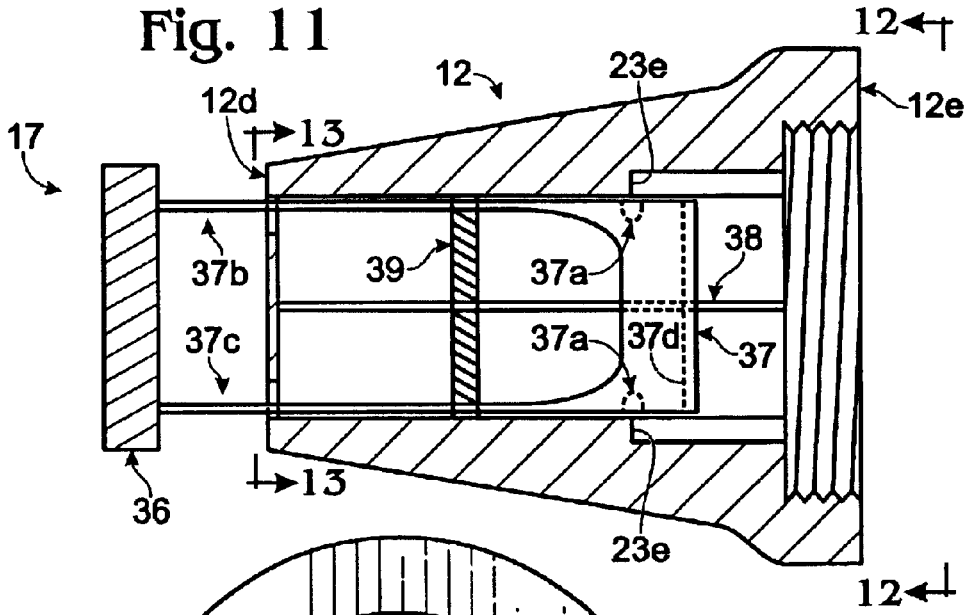
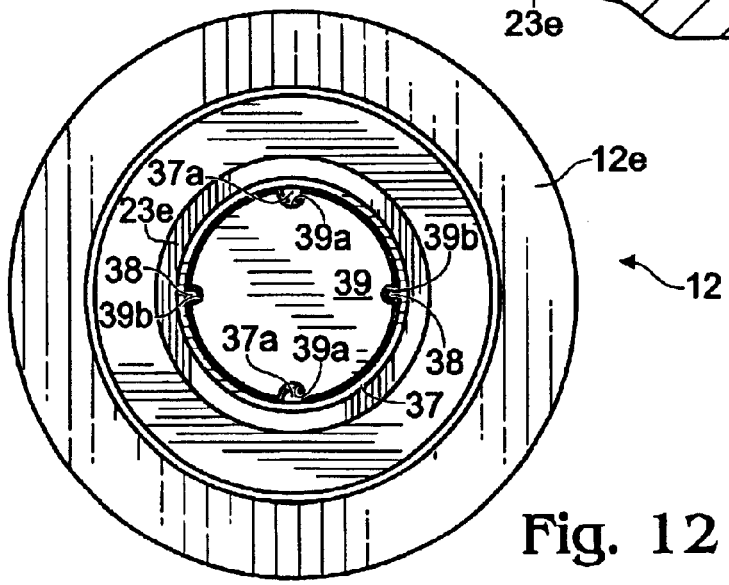
Fig. 12

UNIT DOSE SYRINGE SHIELD AND MEASURING APPLICATOR

CROSS REFERENCE

This application is a continuation-in-part to U.S. patent application Ser. No. 10/241418 entitled "Improvement For Unit Dose Syringe Shield And Measuring Applicator", filed Sep. 11, 2002 which is itself a continuation in part of U.S. patent application Ser. No. 10/167025 entitled "Unit Dose Syringe Shield And Measuring Applicator," filed on Jun. 11, 2002, now U.S. Pat. No. 6,614,040 the entire disclosure of which is hereby incorporated by reference.

FIELD OF THE INVENTION

This invention relates to an apparatus for transporting and administering radiopharmaceuticals, and more particularly to a radionuclide syringe shield and dose measuring applicator.

BACKGROUND OF THE INVENTION

Radiopharmaceuticals are radioactive material which are widely used in the diagnosis and treatment of various diseases and body disorders. Radiopharmaceuticals are typically injected into the body of a patient by means of a hypodermic syringe. The repeated exposure to radioactive materials may over time present serious health hazards to the person preparing and administering the injection. This hazard is a result of radiation emanating from radioactive material which is to be injected.

Nuclear medicine technologists may receive significant radiation exposure when repeatedly handling radiopharmaceuticals, particularly high-energy radionuclides such as, for example, F-18 fluorodeoxyglucose. The technologists are particularly at risk when preparing the dose prior to injection and following injection from direct exposure to the patient. However, the latter risk can be avoided by increasing the distance from the patient while injecting the dose and decreasing time spent near the patient after the injection.

The exposure during the dose measuring procedure occurs when the dose is removed from the shipping container, when the dose is placed into and removed from the well counter and when the dose is inserted into the syringe shield. For example, the technologist's upper extremities receive a significant dose of radiation during the time the dose is unshielded. The prior art syringe shields (pigs) do not allow for measurement unless the syringe is removed from them resulting in direct exposure to the technologist's upper extremities.

Existing devices that provide radiation shielding when the hypodermic syringe is being used to inject the patient, offer only limited radiation shielding. In Applicant's co-pending Application No. 10/241418, there is no radiation shielding at the piston end of the hypodermic syringe when the injection is being administered. This exposes the individual performing the injection to undesirable radiation. Furthermore, such devices require additional time to administer the injection because the protective shielding must be removed from the piston end of the hypodermic syringe before the injection can be administered.

What is needed is an apparatus that will allow the measuring procedure to be carried out without the technologist being exposed to radiation from the radionuclide contained in the syringe. What is further needed is the ability of the same apparatus to act as a syringe shield to prevent escape of radiation from the radionuclide in the syringe, while it is being transported to the patient for injection. What is further needed is the ability of the same apparatus to be used to inject the patient while preventing radionuclide exposure through the piston end of the syringe.

SUMMARY OF THE INVENTION

It is an aspect of the present invention to shield the technologist from radionuclide exposure while inserting the hypodermic syringe into a well counter.

It is another aspect of the present invention to allow a measuring procedure to be carried out without the technologist being directly exposed to the radionuclide in the hypodermic syringe.

It is yet another aspect of the present invention to provide improved radiation shielding when the hypodermic syringe is being used to inject the patient.

To accomplish these and other aspects of the present invention an apparatus that transports radiopharmaceuticals and protects individuals from radioactivity during measurement and injection includes a first body with a first hollow core open on a first edge and a second edge. The first hollow core surrounds an insert containing a hypodermic syringe. The apparatus further includes a second body with a second hollow core open on a first edge and a third body with a third hollow core open on a first edge. The second hollow core surrounds the insert with the hypodermic syringe. The third hollow core surrounds the insert with the hypodermic syringe.

The second body includes means for compressing the piston of the hypodermic syringe to eject the radiopharmaceutical from the hypodermic syringe and providing protection from the radioactivity. In the preferred embodiment, the means for compressing comprises a piston actuator that includes a sliding sleeve, guides and a disk for activating the piston of the hypodermic syringe to eject the radiopharmaceutical from the hypodermic syringe when the third body is removed and providing protection from radioactivity.

The third body includes extension means that allow the insert containing the hypodermic syringe to be extended from the first and third bodies when the second body has been removed. In the preferred embodiment, the extension means comprises a dose applicator that include a nut, two telescoping rods attached to the nut, and means for releasably attaching the telescoping rods to the insert with the hypodermic syringe. The extension means is for positioning the insert and the hypodermic syringe into and out of the first and third bodies whereby said individuals easily measure and transport the radiopharmaceutical in the hypodermic syringe.

A first connection means releasably communicates the first body with the third body and a second communication means releasably communicates the first body with the second body for providing protection from radioactivity.

These and other aspects of the present invention will become apparent from the following description, the description being used to illustrate the preferred embodiment of the invention when read in conjunction with the accompanying drawings.

BRIEF DESCRIPTION OF THE DRAWINGS

FIG. 10 illustrates the cross-section of the piston actuator.

FIG. 11 illustrates another cross-section of the piston actuator, rotated 90° from FIG. 10.

FIG. 12 illustrates an end view of the piston actuator.

DETAILED DESCRIPTION OF THE INVENTION

While the present invention is described below with reference to a syringe shield, a practitioner in the art will recognize the principles of the present invention are applicable elsewhere.

Figure 1:
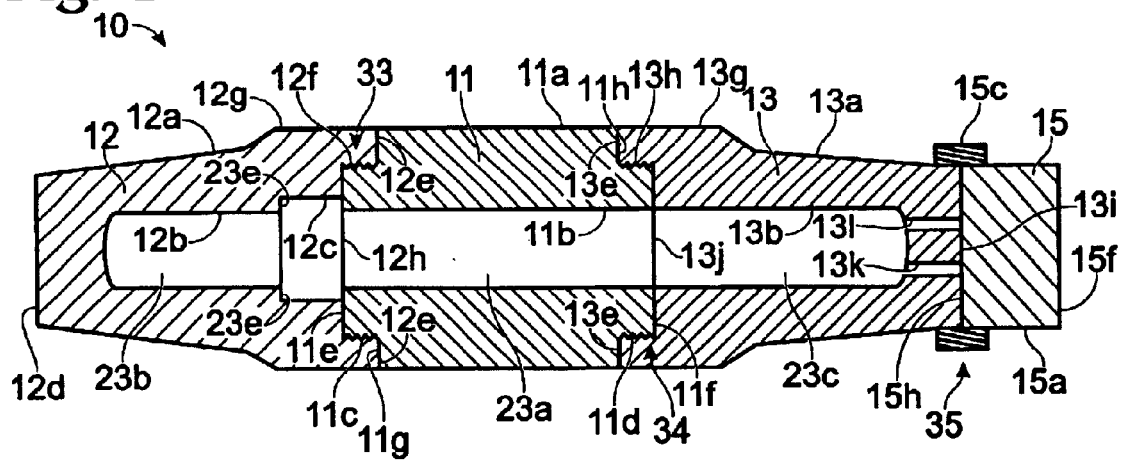
FIG. 1 illustrates the cross-section view of the double-ended syringe shield without the dose applicator.
Figure 8:
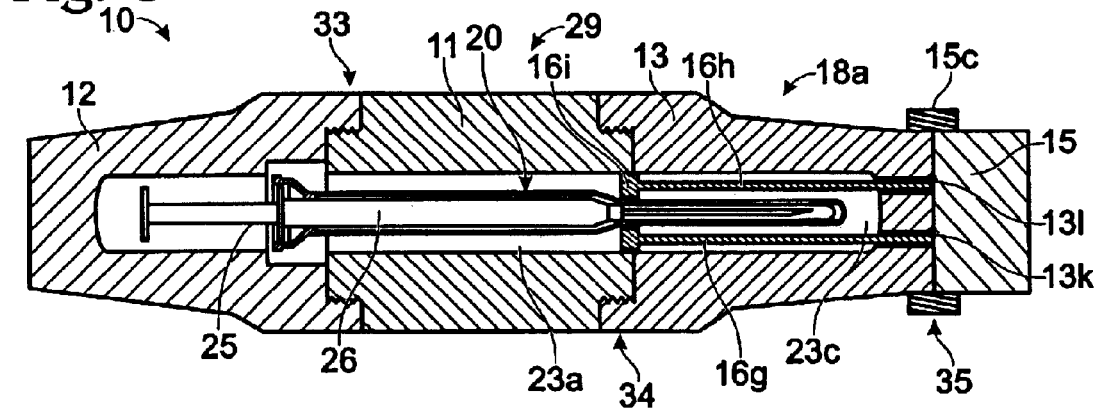
FIG. 8 illustrates the cross-section view of the double-ended syringe shield, transporter and dose applicator with hypodermic syringe.

FIG. 1 illustrates the cross-section of a double-ended syringe shield apparatus 10. The double-ended syringe shield is used to transport a hypodermic syringe 25 with a radioactive pharmaceutical 26 (FIG. 8). The first body 11 releasably communicates with the second body 12 and the first body 11 releasably communicates with the third body 13. The third body 13 releasably communicates with the nut 15. The hypodermic syringe and a one-piece insert are positioned inside the apparatus 10 as shown in FIG. 8. The first body 11 has a first hollow core 23*a* that is formed all the way through the first body 11 from the first body first edge 11*f* to the to the first body second edge 11*e*. The diameter of the first hollow core 23*a* that is formed by the first body inner surface 11*b* is a variety of sizes depending on the size of the hypodermic syringe and insert to be used. The first body 11 shape is defined by the first body outer surface 11*a* and is typically machined. However, as is known by the practitioner in the art, the machining of the first body inner surface 11*b* and the first body outer surface 11*a* is substitutable for casting the first body 11. Furthermore, the first body first edge 11*f* and the first body second edge 11*e* are typically formed in parallel planes.

The first connection means 34 located at the first body first edge 11*f* is usually a first male thread 11*d*. It is formed starting at the first body first edge 11*f* with a diameter that is smaller than the first outer surface 11*a* and larger than the diameter of the first inner surface 11*b*. Typically, the first male thread 11*d* diameter is formed in the range of about 70% to 85% of the diameter of the first outer surface 11*a*. It is machined back from the first body first edge 11*f* to the first body fourth edge 11*h* for a depth of about 15% of the overall length of the first body 11. The first male thread 11*d* is usually a unified fine thread or a unified coarse thread.

The second connection means 33 at the first body second edge 11*e* that is usually a second male thread 11*c*. It is formed starting at the first body second edge 11*e* with a diameter that is smaller than the first outer surface 11*a* and larger than the diameter of the first inner surface 11*b*. Typically, the second male thread 11*c* diameter is formed in the range of about 70% to 85% of the diameter of the first outer surface 11*a*. It is machined back from the first body second edge 11*e* to the first body third edge 11*g* for a depth of about 15% of the overall length of the first body 11. The second male thread 11*c* is typically a unified fine thread or a unified coarse thread.

In other applications, the male thread connections are substitutable for female threads, a locking nut arrangement or a compression flange arrangement as is known by the practitioner in the art. The first outer surface 11*a* is cylindrical in shape but is readily substitutable for any circular or polyhedron shape. Finally, the wall thickness between the first outer diameter 11*a* and the first inner diameter 11*b* must contain enough radiation shielding material to provide adequate protection against radiation exposure. The radiation is from the radiopharmaceutical 26 contained within the hypodermic syringe.

The second body 12 has a second hollow core 23*b* that is formed by starting from the second body third edge 12*e* to a depth that is about 75% to 85% of the length of the second body 12. The diameter of the second hollow core 23*b* that forms the second inner surface 12*b* is a variety of sizes depending on the size of the hypodermic syringe and insert to be positioned in the second hollow core 23*b*. The second hollow core 23*b* is formed before the formation of the third inner surface 12*c* and the first female thread 12*f*. The second body 12 shape is defined by the second body tapered first outer surface 12*a* and a second body second outer surface 12*g*, wherein both are typically formed by machining and cylindrically shaped. Typically, the second body second outer surface 12*g* is machined. However, as is known by the practitioner in the art, machining is substitutable for casting the second body 12. Alternately, the second body second outer surface 12*g* can have the same tapered plane as the second body tapered first outer surface 12*a*.

The second body second outer surface 12*g* at the second body third edge 12*e* is usually flush with the first body first outer surface 11*a*. Furthermore, the second body first edge 12*h*, the second body second edge 12*d* and the second body third edge 12*e* are all typically formed in parallel planes. The cylindrical shape of the second body 12 is substitutable for any circular or polyhedron shape. Finally, the wall thickness between the second outer surface 12*g*, the second body tapered first outer surface 12*a* and the second inner surface 12*b* must contain enough radiation shielding material to provide adequate protection against radiation exposure.

The second connection means 33 at the second body third edge 12*e* is usually a first female thread 12*f* that is formed by machining either a unified fine thread or a unified coarse thread. The first female thread 12*f* is formed starting at the second body third edge 12*e* with a diameter that is smaller than the second body second outer surface 12*g* and larger than the diameter of the second inner surface 12*b*. Typically, the first female thread 12*f* diameter is formed in the range of about 70% to 85% of the diameter of the second body tapered first outer surface 12*a* or the second body second outer surface 12*g*. The first female thread 12*f* is machined back from the second body third edge 12*e* to the second body first edge 12*h* for a depth that is about 10% to 15% the distance of the overall length of the second body 12. Alternately, the first female thread 12*f* is substitutable for a male thread, a locking nut arrangement or a compression flange arrangement as is known by the practitioner in the art.

Figure 3:
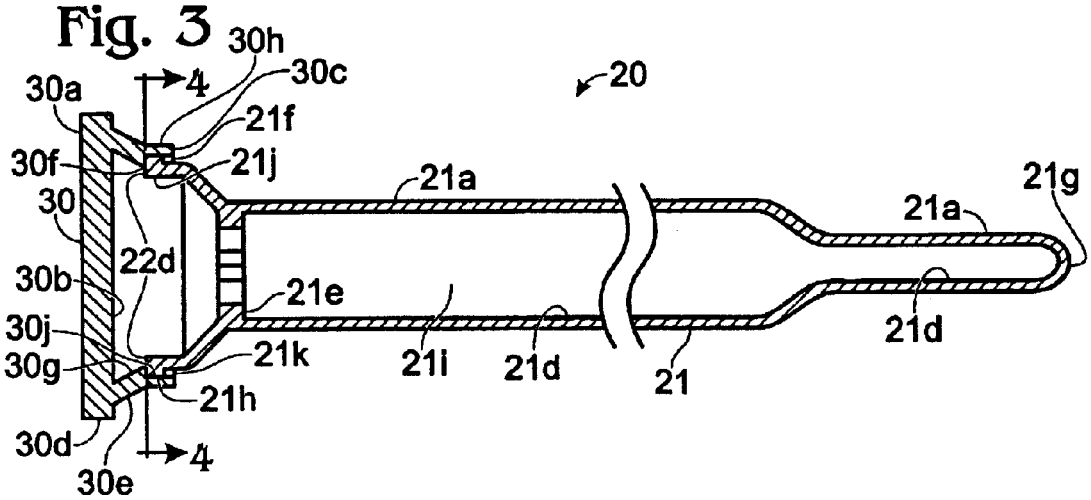
FIG. 3 illustrates the cross-section view of the insert device.

There is a second body annular ridge 23*e* that is formed to provide a means for the insert (FIG. 3) to be coaxially secured to the third inner surface 12*c*. The diameter of the third inner surface 12*c* depends upon the diameter of the insert second outer surface 21*f* (FIG. 3). Typically, the third inner surface 12*c* is the size to fit an insert that accepts 3 cc or 5 cc hypodermic syringes.

The third body 13 has a third hollow core 23*c* that is formed by starting from the third body third edge 13*e* to a depth that is about 75% to 85% the length of the third body 13. The diameter of the third hollow core 23*c* that is formed at the fourth inner surface 13*b* is a variety of sizes depending upon the size of the insert and hypodermic syringe to be used. The cylindrical shape of the third body 13 is defined by the third body tapered second outer surface 13*a* and the third body first outer surface 13*g*, wherein both are typically machined. However, machining the fourth inner surface 13*b*, the third body tapered second outer surface 13*a* and the third body first outer surface 13*g* is substitutable for casting the entire third body 13. Alternately, the third body first outer surface 13*g* can have the same tapered plane as the third body tapered second outer surface 13*a*. The third body first outer surface 13*g* that is formed at the third body third edge 13*e* is flush with the first outer surface 11*a*. Furthermore, the third body first edge 13*j*, the third body second edge 13*i* and the third body third edge 13*e* are all typically formed in parallel planes. The cylindrical shape of the third body 13 is substitutable for any circular or polyhedron shape. Finally, the wall thickness between the third body first outer surface 13*g*, the third body tapered second outer surface 13*a* and the fourth inner surface 13*b* must contain enough radiation shielding material to provide adequate protection against radiation exposure.

The first connection means 34 at the third body third edge 13*e* is usually a second female thread 13*h* that is formed by machining either a unified fine thread or a unified coarse thread. The second female thread 13*h* is formed starting at the third body third edge 13*e* with a diameter that is smaller than the third body first outer surface 13*g* and smaller than the second tapered outer surface 13*a*. The second female thread 13*h* is formed at a diameter that is larger than the fourth inner surface 13*b*. Typically, the second female thread 13*h* diameter is formed in the range of about 70% to 85% of the diameter of the third body first outer surface 13*g* or the third body tapered second surface 13*a*. The second female thread 13*h* is machined back from the third body third edge 13*e* to the third body first edge 13*j* for a depth that is about 15% to 25% the length of the third body 13. As is known in the art, the second female thread 13*h* is substitutable for a male thread, a locking nut arrangement or a compression flange arrangement.

The third connection means 35 that is located at the third body second edge 13*i* is a releasable wrap 15*c* that releasably secures the third body 13 to the nut 15. Typically, the releasable wrap 15*s* is a fabric hook or loop fastener, but is substitutable for any fastener that is easy to use. For example, the first telescoping rod 16*h* and second telescoping rod 16*g* can be sized to form a snug but releasable fit in the first hollow stem 13*l* and second hollow stem 13*k*, allowing the nut 15 to be secured to the third body 13 by friction.

Figure 2:
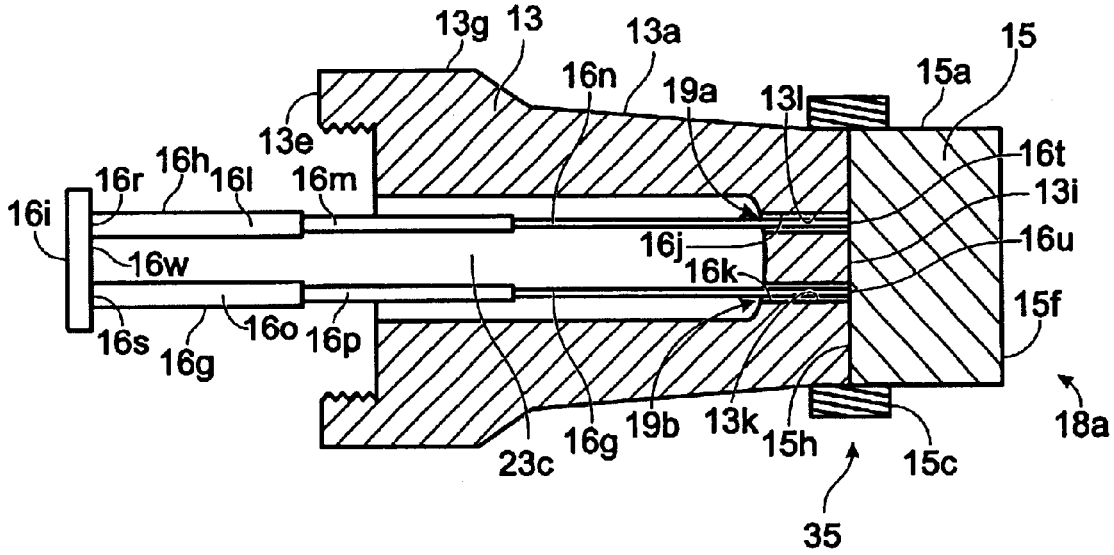
FIG. 2 illustrates the cross-section of the dose applicator used in the double-ended syringe shield.

The first hollow stem 13*l* and the second hollow stem 13*k* that are located in the third body 13 are both formed by either machining or drilling. The third hollow core 23*c* fixedly communicates with the two hollow stems. The two hollow stems are open on the third body second edge 13*i* and the third hollow core 23*c*. The first hollow stem 13*l* and the second hollow stem 13*k* are symmetrically positioned around the center of the third body second edge 13*i*. The first hollow stem 13*l* is formed large enough to allow the positioning of the first telescoping rod 16*h* (FIG. 2). Furthermore, the second hollow stem 13*k* is formed large enough to allow the positioning of the second telescoping rod 16*g* (FIG. 2). Typically the first hollow stem 13*l* and the second hollow stem 13*k* are drilled. However, drilling is substitutable for casting the hollow stems into the third body.

The nut 15 has a nut outer surface 15*a* that is radially formed for a flush-fit with the third body tapered second outer surface 13*a*. The nut outer edge 15*f*, the nut inner edge 15*h* and the third body second edge 13*i* are all formed in parallel planes. This allows the nut 15 to fit snugly against the third body 13 when the third connection means 35 is used. Finally, the thickness of material required between the nut outer edge 15*f* and the nut inner edge 15*h* is enough to adequately prevent radiation from leaking through the nut 15 in any direction.

Figure 13:
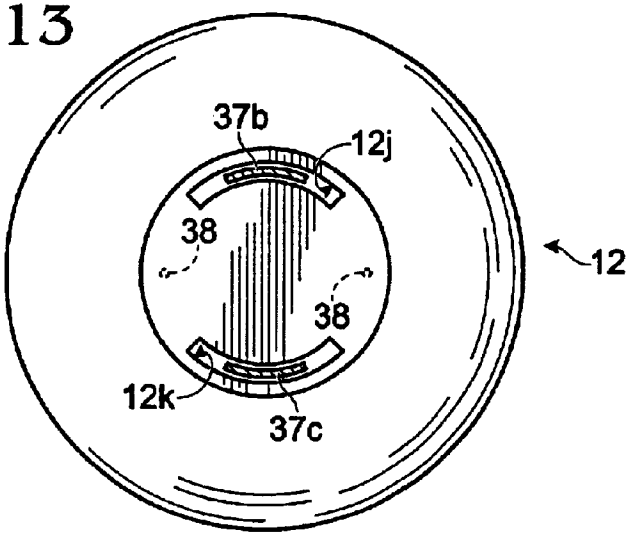
FIG. 13 illustrates an end view of the piston actuator viewed from the opposite direction of FIG. 12.
Figure 14:
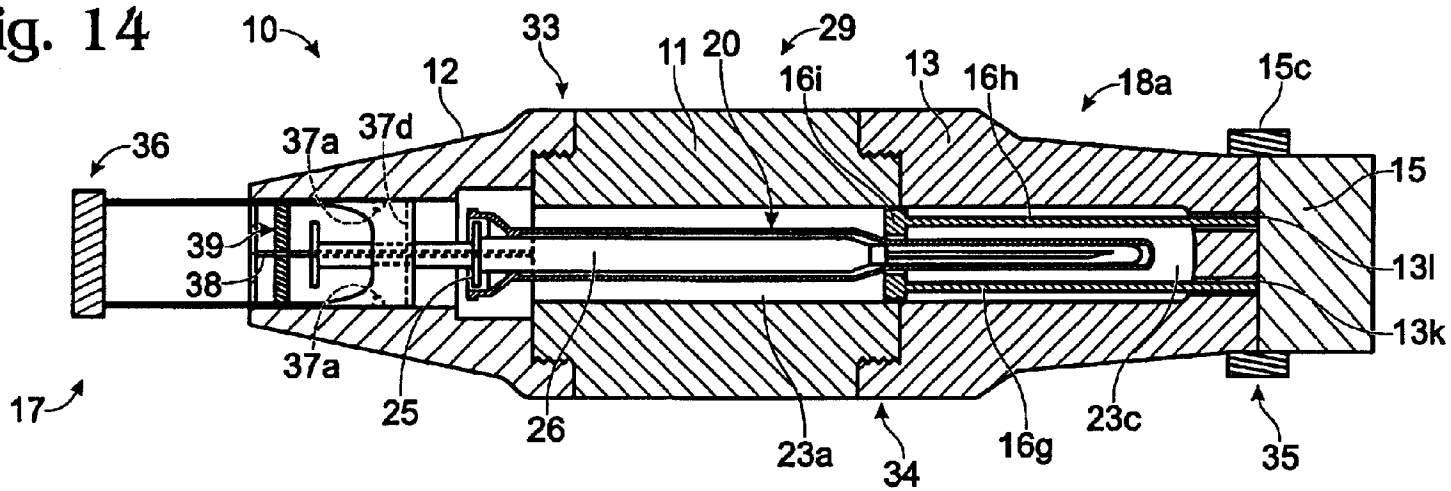
FIG. 14 illustrates the cross-section of the dose applicator, incorporating the piston actuator.

The first hollow slot 12*j* and the second hollow slot 12*k* that are located in the second body 12 are both formed by either machining, casting or drilling. The second hollow core 23*b* fixedly communicates with the two hollow slots. The two hollow slots are open on the second body second edge 12*d* and the second hollow core 23*b*. The first hollow slot 12*j* and the second hollow slot 12*k* are symmetrically positioned around the center of the second body second edge 12*d*. The first hollow slot 12*j* is formed large enough to allow the positioning of the first arm of the internal sleeve 37*b* (FIG. 13). Furthermore, the second hollow slot 12*k* is formed large enough to allow the positioning of the second arm of the internal sleeve 37*c*. Typically the first hollow slot 12*j* and the second hollow slot 12*k* are machined.

Preferably, the actuator cap 36 outer surface is radially formed for a flush-fit with the second body second 12*e*. The actuator cap 36 fits snugly against the second body 12. Finally, the thickness of the actuator cap 36 is enough to adequately prevent radiation from leaking through the actuator cap 36 in any direction.

The double-ended syringe shield apparatus 10, as illustrated in FIG. 1, shows the nut 15 communicating with the third body 13 by the third connection means 35. The third body 13 communicates with the first body 11 by the first connection means 34. The first body 11 communicates with the second body 12 by the second connecting means 33. The first body first edge 11*f*, the first body second edge 11*e*, the first body third edge 11*g*, the first body fourth edge 11*h*, the second body first edge 12*h*, the second body third edge 12*e*, the third body third edge 13*e* and the third body first edge 13*j* are formed in parallel planes. The forming in parallel planes allows the first connection means 34 to be a snug fit between the first body 11 and the third body 13, when they are securely connected by axially threading the first body 11 and third body 13. The forming in parallel planes allows the second connection means 33 to be a snug fit between the first body 11 and the second body 12, when they are securely connected by axially threading the first body 11 and second body 12.

FIG. 2 illustrates the cross-section of the dose applicator 18*a* used in the double-ended syringe shield apparatus 10 in the preferred embodiment of the invention. The dose applicator 18*a* communicates with and is releasably secured to the third body 13 by using a releasable wrap 15*c*. The dose applicator 18*a* is used, for example, when it is desired to load the hypodermic syringe 25 (FIG. 7) into a well counter allowing radiation shielding. The dose applicator 18*a* consists of a nut 15, a first telescoping rod 16*h*, a second telescoping rod 16*g* and an insert holder 16*i*. The first telescoping rod 16*h* is positioned into the first hollow stem 13*l* and communicates with the nut 15. The second telescoping rod 16*g* is positioned into the second hollow stem 13*k* and communicates with the nut 15. The first telescoping rod 16*h* further consists of a first telescoping rod first section 16*l* that is larger in diameter and slides around a first telescoping rod second section 16*m* that is larger in diameter and slides around a first telescoping rod third section 16*n*. Furthermore the second telescoping rod 16*g* consists of a second telescoping rod first section 16*o* that is larger in diameter and slides around a second telescoping rod second section 16*p* that is larger in diameter and slides around a second telescoping rod third section 16*q*. The insert holder 16i securely fastens to the first telescoping rod first section outer end 16*r* and the second telescoping rod first section outer end 16*s*. The nut 15 securely fastens to the first telescoping rod third section outer end 16*t* at the nut inner edge 15*h*. The nut 15 securely fastens to the second telescoping rod third section outer end 16*u* at the nut inner edge 15*h*. Finally, the first telescoping rod 16*h* and the second telescoping rod 16*g* are symmetrically positioned inside the third hollow core, wherein the insert 20 (FIG. 3) can be positioned between them and be releasably secured by the insert holder 16*i*.

The first hollow stem 13*l* is sized providing a first gap 19*a* between the first hollow stem circumferential surface 16*j* and the first telescoping rod first section 16*l*. The first gap 19*a* is large enough to allow the first telescoping rod 16*h* to completely extend or retract inside the first hollow stem 13*l*. The second hollow stem 13*k* is sized providing a second gap 19*b* between the second hollow stem circumferential surface 16*k* and the second telescoping rod first section 16*o*. The second gap 19*b* is large enough to allow the second telescoping rod 16*g* to completely extend or retract inside the second hollow stem 13*k*.

The third connection means 35 comprises the nut 15 that releasably communicates with the third body 13 and the releasable wrap 15*c*. Typically, the releasable wrap 15*c* is a fabric hook or loop fastener but the fabric can be substitutable for any connection that is easy to use. The nut outer edge 15*f*, the nut inner edge 15*h* and the third body second edge 13*i* are all formed in parallel planes. The edges formed in parallel planes allow the nut 15 and the third body 13 to releasably communicate with a snug fit when the dose applicator 18*a* is retracted. The releasable wrap 15*c* is positioned around the third body tapered second outer surface 13*a* and the nut outer surface 15*a* to releasably secure the nut 15 to the third body 13. The nut outer surface 15*a* and the third body tapered second outer surface 13*a* are formed by machining to produce a flush-fit when the nut inner edge 15*h* and the third body second edge 13*i* communicate with each other. Alternately, the nut can be cast and its edges machined to produce a flush-fit when it communicates with the third body 13. The nut outer surface 15*a* is usually formed at the same diameter as the diameter of the third body tapered second outer surface 13*a* at the third body second edge 13*i*.

Those skilled in the art will recognize that other means of extending the hypodermic syringe 25 from the first body 11 and third body 13 are within the scope of the present invention. For example, a chain or cable can be substituted for the telescoping rods 16*h* and 16*g* to lower the hypodermic syringe 25 into a well counter and then to raise the hypodermic syringe into the first body 11 and third body 13.

The first telescoping rod 16*h* and the second telescoping rod 16*g* are substitutable for one telescoping rod. The single telescoping rod is circumferentially mountable on the holder inside edge 16*w* as long as the insert 20 can be positioned and freely movable inside the third hollow core 23*c*, the second hollow core 23*b* and the first hollow core 23*a*.

Figure 9:
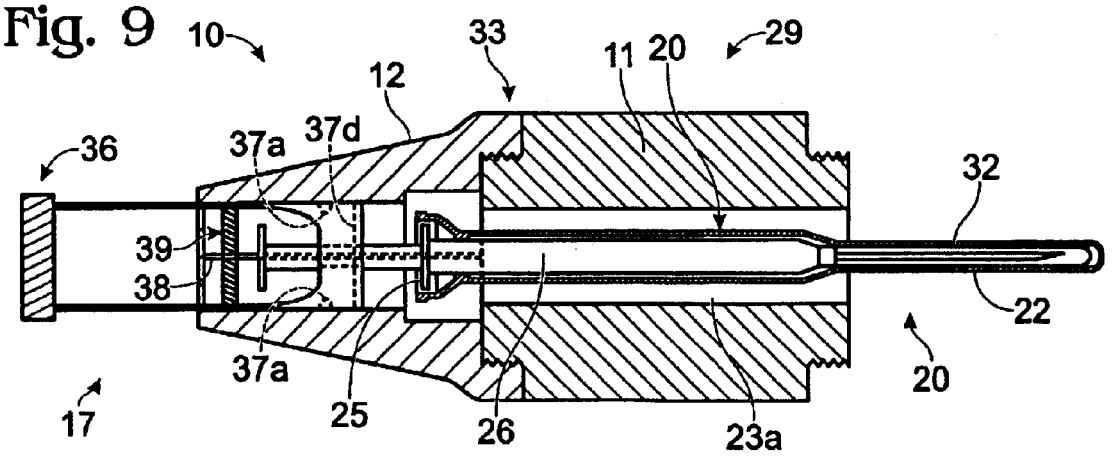
FIG. 9 illustrates the cross-section of the double-ended syringe shield with the double piece insert and hypodermic syringe ready to be injected into a patient.
Figure 7:
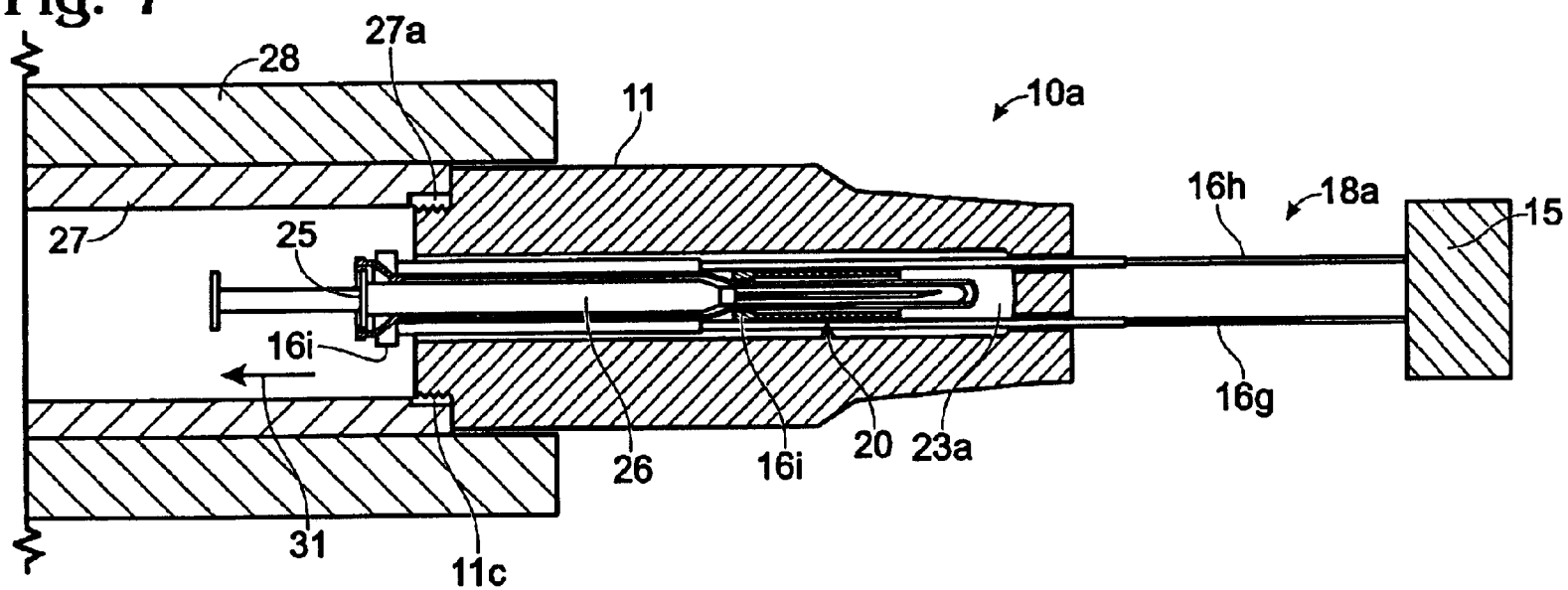
FIG. 7 illustrates the cross-section view of the dose applicator used in the single-ended syringe shield with a hypodermic syringe positioned in a well counter.

FIG. 3 is a cross-section illustration of the one piece insert 20. The insert 20 consists of a first section 21 and a cover 30. Alternately, the insert 20 may consist of a first and second section with a cover. The second section 22 is removable from the first section 21 along a perforation 21*b* between the first and second section (FIG. 9). The first section inner surface 21*d* has a diameter large enough to allow a 3 cc or 5 cc hypodermic syringe to be placed inside the insert 20. Alternately, the first section first inner surface 21*d* diameter is substitutable for various sizes allowing different sizes of the hypodermic syringe to be placed inside 21*i* the insert 20. The first section first outer surface diameter 21*a* is small enough to fit between the first telescoping rod 16*h* (FIG. 2) and second telescoping rod 16*g* (FIG. 2). The first section first end 21*g* is usually rounded to the same size as the radius of the first section inner surface 21*d* so that the insert 20 will easily fit into the insert holder 16*i* (FIG. 7) when, for example, the hypodermic syringe 25 is being transported to a well counter 28. The diameter of the first section second outer surface 21*f* is larger than the diameter of the first section first outer surface 21*a*. The transition from the first section first outer surface 21*a* diameter to the first section second outer surface 21*f* diameter is in the shape of a tapered cylinder or a cone. This shape allows the insert 20 to be positioned and releasably secured by the insert holder 16*i* (FIG. 7). Alternately, the cone shape is substitutable for any polyhedron shape.

The first section second end annular lip 21*h* protrudes slightly from the first section second outer surface 21*f* so that the cover 30 is secured to the first section second end 22*d* by a snap fit. Also, the first section inner annular lip 21*e* allows the hypodermic syringe 25 (FIG. 7) to snugly fit into the insert 20. The first section inner annular lip 21*e* is integrally a part of the first section 21 where the first section first outer surface 21*a* begins transitioning to the first section second outer surface 21*f*. Finally, the first section 21 is typically a clear molded plastic. However, any material is suitable as long as it is can be seen through after being molded.

The cover 30 is defined by the cover outer end 30*a*, the cover inner end 30*b*, the cover first outer surface 30*d*, the cover tapered outer surface 30*e* and the cover second outer surface 30*h*. The cover 30 is further defined by the cover annular lip 30*c*, the cover lip annular ridge 30*f* and the cover tapered inner surface 30*g*. The cover 30 is removably attached to the first insert second end 22*d* by a snap fit. The cover annular lip 30*c* that is integrally a part of the cover 30 is positioned so as to communicate with the first section second end annular lip 21*h*, at the second end annular lip inner end 21*k*, and the cover annular lip inner end 30*j*. The cover tapered inner surface 30*g* diameter is normally larger at its narrowest diameter than the diameter of the first section second inner surface 21*j*. Furthermore, the cover lip annular ridge 30*f* is formed allowing the cover annular lip 30*c* to snap fit around the first section second end annular lip 21*h*. Finally, the cover 30 is typically a clear molded plastic. However, any material is suitable as long as it can be seen through after being molded. The cover 30 would not normally be attached to the insert 20 after the hypodermic syringe 25 has been filled with radiopharmaceutical 26.

Alternatively, in uses where a covered syringe is not required by medical protocol, the syringe shield can operate without a syringe insert 21. This would be the case, for example, when a syringe will not be in contact with a patient's blood, such as when the radiopharmaceutical 26 will be injected into an intravenous fluid delivery system rather than directly into a patient's body. In such a case, the third inner surface 12*c* would be sized to the hypodermic syringe 25 rather than to the syringe insert 20. In addition, the insert holder 16*i* would be sized to securely hold the hypodermic syringe 25 rather than the syringe insert 20.

Figure 4:
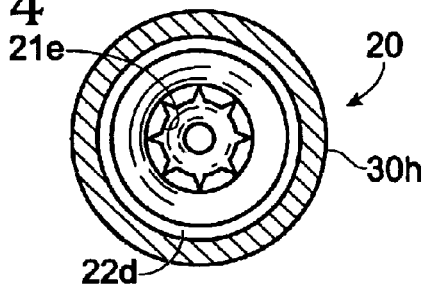
FIG. 4 illustrates the end-view of the insert device.

FIG. 4 shows the end view of the insert 20 with the cover second outer surface 30*h*, the first insert second end 22*d* and the first section inner annular lip 21*e*.

Figure 5:
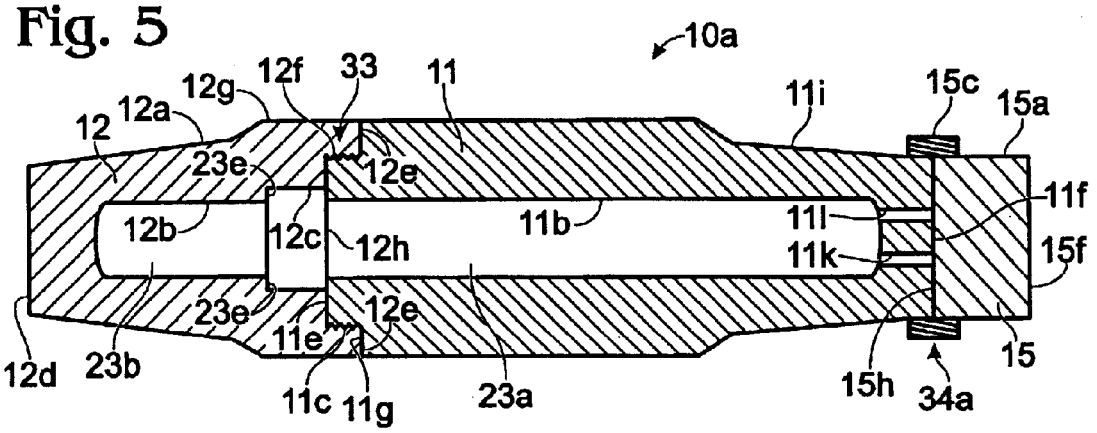
FIG. 5 illustrates the cross-section view of the single-ended syringe shield without the dose applicator.
Figure 6:
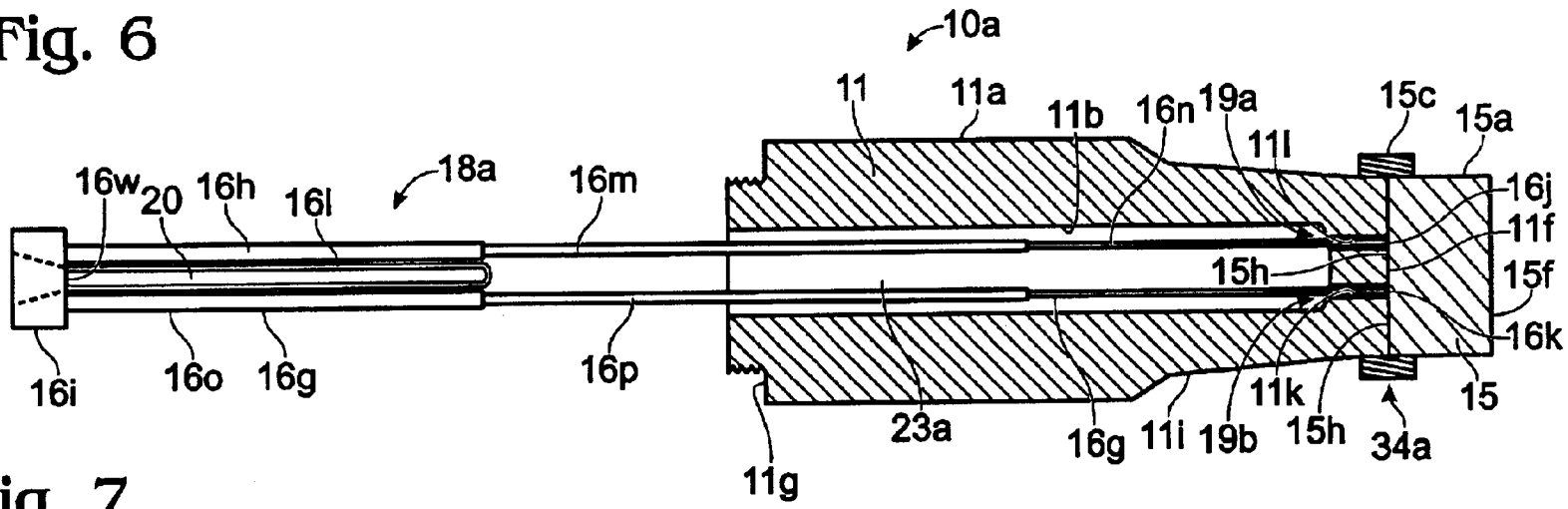
FIG. 6 illustrates the cross-section of the dose applicator used in the single-ended syringe shield.

FIG. 5 illustrates the cross-section view of the single ended syringe shield 10*a* without the dose applicator 18*a* (FIG. 6). The single-ended syringe shield is used to transport a hypodermic syringe 25 with a radioactive pharmaceutical 26 (FIG. 8). The first body 11 releasably communicates with the second body 12 and the first body 11 releasably communicates with the nut 15. The hypodermic syringe and a one-piece insert are positioned inside the apparatus 10*a* as shown in FIG. 8. The first body 11 has a first hollow core 23*a* that is formed all the way through the first body 11 from the first body first edge 11*f* to the to the first body second edge 11*e*. The diameter of the first hollow core 23*a*, that is formed by the first body inner surface 11*b*, is a variety of sizes depending on the size of the hypodermic syringe and insert to be used. The first body 11 shape is defined by the first body first outer surface 11*a* and the first body tapered second outer surface 11*i*. All the surfaces of the first body 11 are usually machined. As is known by the practitioner in the art, the machining of the first body inner surface 11*b*, the first body first outer surface 11*a* and the first body tapered second surface 11*i* is substitutable for casting the first body 11. Furthermore, the first body first edge 11*f* and the first body second edge 11*e* are typically formed in parallel planes.

The first connection means 34*a* at the first body first edge 11*f* is usually a releasable wrap 15*c*. Typically, the releasable wrap 15*s* is a fabric hook or loop fastener, but is substitutable for any fastener that is easy to use.

The second connection means 33 at the first body second edge 11*c* is usually a second male thread 11*c*. It is formed starting at the first body second edge 11*e* at a diameter that is smaller than the first body first outer surface 11*a* and larger than the diameter of the first body inner surface 11*b*. Typically, the second male thread 11*c* diameter is formed in the range of about 70% to 85% the diameter of the first body first outer surface 11*a*. It is machined back from the first body second edge 11*e* to the first body third edge 11*g* for a depth of about 5% the overall length of the first body 11. The second male thread 11*c* is typically a unified fine thread or a unified coarse thread.

In other applications, the male thread connections are substitutable for female threads, a locking nut arrangement or a compression flange arrangement as is known by the practitioner in the art. The first body first outer surface 11*a* is cylindrical in shape but is readily substitutable for any circular or polyhedron shape. Also, the first body 11, the second body 12 and the nut 15 can be cast with machining the ends and the connections. Finally, the wall thickness between the first body first outer diameter 11*a* or the first body tapered second outer surface 11*i* and the first inner diameter 11*b* must contain enough radiation shielding material to provide adequate protection against radiation exposure.

At the first connection means 34*a* the first body first edge 11*f* contains a first hollow stem 11*l* and a second hollow stem 11*k*. The first and second hollow stems are large enough to have positioned inside them the first telescoping rod 16*h* (FIG. 6) and the second telescoping rod 16*g* (FIG. 6). The first and second hollow stems are typically drilled in the first body 11 from the first body first edge 11*f* through to the first hollow core 23*a*.

The second body 12 has a second hollow core 23*b* that is formed starting from the second body third edge 12*e* to a depth that is about 75% to 85% of the length of the second body 12. The second hollow core 23*b* is usually machined. The diameter of the second hollow core 23*b* that is formed by the second inner surface 12*b* is a variety of sizes depending on the size of the hypodermic syringe and insert to be positioned in the second hollow core 23*b*. The second body 12 shape is defined by the second body tapered first outer surface 12*a* and a second body second outer surface 12*g*, wherein both are typically machined and cylindrically shaped. The second body second outer surface 12*g* diameter usually is flush with the first outer surface 11*a*. Alternately, the second body second outer surface 12*g* can have the same tapered plane as the second body tapered first outer surface 12*a*. Typically, the second body second outer surface 12*g* at the second body third edge 12*e* is flush with the first outer surface 11*a*. Furthermore, the second body first edge 12*h*, the second body second edge 12*d* and the second body third edge 12*e* are all typically formed in parallel planes. The cylindrical shape of the second body 12 is substitutable for any circular or polyhedron shape. Finally, the wall thickness between the second outer surface 12*g*, the second body tapered first outer surface 12*a* and the second inner surface 12*b* must contain enough radiation shielding material to provide adequate protection against radiation exposure. The radiation is from the radiopharmaceutical 26 contained within the hypodermic syringe 25 placed inside the second hollow core 23*b*.

The second connection means 33 at the second body third edge 12*e* is usually a first female thread 12*f* that is formed by machining either a unified fine thread or a unified coarse thread. The first female thread 12*f* is formed starting at the second body third edge 12*e* at a diameter that is smaller than the second body second outer surface 12*g* and larger than the diameter of the second inner surface 12*b*. Typically, the first female thread 12*f* diameter is formed in the range of about 70% to 85% of the diameter of the second body tapered first outer surface 12*a* or the second body second outer surface 12*g*. The first female thread 12*f* is machined back from the second body third edge 12*e* to the second body first edge 12*h* for a depth that is about 15% the distance of the overall length of the second body 12. Alternately, the first female thread 12*f* is substitutable for a male thread, a locking nut arrangement or a compression flange arrangement as is known by the practitioner in the art.

There is a second body annular ridge 23*e* that is formed to provide a means for the insert (FIG. 3) to be coaxially and releasably secured to the third inner surface 12*c*. The diameter of the third inner surface 12*c* depends upon the diameter of the insert second outer surface 21*f* (FIG. 3). The third inner surface 12*c* is typically the size to fit an insert that accepts 3 cc or 5 cc hypodermic syringes.

The nut 15 has a nut outer surface 15*a* diameter that is flush with the diameter of the third body tapered second outer surface 13*a* at the first body first edge 11*f*. The nut 15 has a length of about 10% to 15% the length of the first body 11 and extends from the nut outer edge 15*f* to the nut inner edge 15*h*. A first connection means 34*a* is a releasable wrap 15*c* that is typically a fabric hook or loop fastener. Finally, the thickness of material required between the nut outer edge 15*f* and the nut inner edge 15*h* is enough to adequately prevent radiation of leaking through the nut 15 in all directions.

The single-ended syringe shield apparatus 10*a* as illustrated in FIG. 5 shows the nut 15 releasably communicating with the first body 11 by the first connection means 34*a*. The first body 11 releasably communicates with the second body 12 by the second connecting means 33. The first body first edge 11*f*, the first body second edge 11*e*, the first body third edge 11*g*, the second body first edge 12*h* and the second body third edge 12*e* are formed in parallel planes. Additionally, the nut inner edge 15*h* and the nut outer edge 15*f* are formed in parallel planes with the first and second body edges. The forming in parallel planes allows the first connection means 34*a* to be a snug fit between the first body 11 and the nut 15 when they are securely connected by the releasable wrap 15*c*. The forming in parallel planes allows the second connection means 33 to be a snug fit between the first body 11 and the second body 12 when they are securely connected by axially threading the first body 11 and second body 12.

In the preferred embodiment of the invention the radiation shielding material is typically lead. However, in many applications although lead is an excellent radiation shielding material it is unsuitable because it is too heavy and insufficiently flexible. Other materials include, but are not limited to, tungsten. Consequently, the radiation shielding material is any material that will attenuate the photons released from the radioactive agent. For example, a radiation shielding material is obtainable from lead acrylate or lead methacrylate combined by polymerizing it at a temperature above the melting point in a mixture with a copolymerizable monomer such as methyl methacrylate. Alternately, another radiation shielding material comprises an elastomeric or rubbery plastics material filled with lead particles. These materials combine the excellent radiation shielding properties of lead with other materials that weigh less than lead to provide a good radiation shield that is flexible and not too heavy.

Another commonly utilized radiation shielding material is tungsten. When tungsten, a tungsten compound or a tungsten based alloy is used as the material with high radiation absorptivity, when the γ-ray absorption coefficient of tungsten is not less than about 1 when the energy of the γ-ray is 511 KeV or greater, there is provided a safe radiation shielding material. For example, one such tungsten compound with high radiation absorptivity is a tungsten powder that is not less than 80% by weight or greater than 95% by weight combined with vulcanized rubber. The tungsten powder in combination with the vulcanized rubber has particle sizes in the range of about 4$\mu$ to 100 $\mu$m. When a tungsten alloy is used for the radiation shielding material a typical combination includes but is not limited to a hard-find grained internally stressed material of tungsten and carbon or tungsten, carbon and oxygen.

The insert holder 16*i* material is non-attenuating typically a plastic, a fiberglass or a polyethylene that is easily formed into the shape required to hold the insert 20 as shown in FIG. 2 and FIG. 6. In another embodiment the insert holder 16*i* is shaped so that it can directly position and hold the hypodermic syringe 25 without using the insert 20. The first telescoping rod 16*h* and the second telescoping rod is typically constructed from a light weight material, preferably a non-attenuating material.

FIG. 6 illustrates the cross-section of the single-ended syringe shield 10*a* with the dose applicator 18*a*. The dose applicator 18*a* communicates with and is releasably secured to the first body 11. The dose applicator 18*a* is used, for example, when it is desired to load the hypodermic syringe 25 (FIG. 7) into a well counter 28, wherein individuals are shielded from radiation emanating from the radiopharmaceutical 26 in the hypodermic syringe 25. The dose applicator 18*a* consists of a nut 15, a first telescoping rod 16*h*, a second telescoping rod 16*g* and an insert holder 16*i*. The first telescoping rod 16*h* is positioned into the first hollow stem 11*l* and communicates with the nut 15. The second telescoping rod 16*g* is positioned into the second hollow stem 11*k* and communicates with the nut 15. The first telescoping rod 16*h* further consists of a first telescoping rod first section 16*l* that is larger in diameter and slides around a first telescoping rod second section 16*m* that is larger in diameter and slides around a first telescoping rod third section 16*n*. Furthermore the second telescoping rod 16*g* consists of a second telescoping rod first section 16*o* that is larger in diameter and slides around a second telescoping rod second section 16*p* that is larger in diameter and slides around a second telescoping rod third section 16*q*. The insert holder 16*i* securely fastens to the first telescoping rod first section outer end and the second telescoping rod first section outer end. The nut 15 securely fastens to the first telescoping rod third section outer end and the second telescoping rod third section outer end at the nut inner edge 15*h*. The first telescoping rod 16*h* and the second telescoping rod 16*g* are symmetrically positioned inside the third hollow core, wherein the insert 20 can be positioned between them and be releasably secured by the insert holder 16*i*.

The first hollow stem 11*l* is sized providing a first gap 19*a* between the first hollow stem circumferential surface 16*j* and the first telescoping rod first section 16*l*. The first gap 19*a* is large enough to allow the first telescoping rod 16*h* to completely extend or retract within the first hollow core 23*a*. The second hollow stem 11*k* is sized providing a second gap 19*b* between the second hollow stem circumferential surface 16*k* and the second telescoping rod first section 16*o*. The second gap 19*b* is large enough to allow the second telescoping rod 16*g* to completely extend or retract within the first hollow core 23*a*. The first body inner surface 11*b* is formed large enough to allow a slideable movement of the insert holder inside the hollow core 23*a*.

The first connection means 34*a* comprises the nut 15 with a releasable wrap 15*c* that is releasably secured to the first body 11. Typically, the releasable wrap 15*c* is a fabric hook or loop fastener, but is substitutable for any fastener that is easy to use. The nut outer edge 15*f*, the nut inner edge 15*h* and the first body first edge 11*f* are all formed in parallel planes. The edges formed in parallel planes allow the nut 15 and the first body 11 to be releasably secured with a snug fit between the nut inner edge 15*h* and the first body first edge 11*f* when the releasable wrap 15*c* is used. The nut outer surface 15*a* diameter is formed flush with the first body tapered second outer surface 11*i* at the first body first edge 11*f*. However, the nut outer surface 15*a* can have a diameter that is either larger or smaller than the diameter of the first body tapered second outer surface 11*i* at the first body first edge 11*f*. Typically, the nut edges and surfaces and the first body edges and surfaces are formed by machining to produce a snug-fit at the edges and a flush-fit at the surfaces. Alternately, the nut and first body can be cast with their edges machined to produce a snug fit when they are connected together.

In the preferred embodiment of the invention the first body first outer surface 11*a* is typically formed as a straight cylinder while the first body tapered second outer surface 11*i* is formed as a cone. Alternately, the first body first outer surface 11*a* is substitutable for a tapered surface that matches the first body tapered second outer surface 11*i*.

The first telescoping rod 16*h* and the second telescoping rod 16*g* are substitutable for one telescoping rod. The single telescoping rod is circumferentially mountable on the holder inside edge 16*w* as long as the insert 20 can be positioned and freely movable inside the third hollow core 23*c*, the second hollow core 23*b* and the first hollow core 23*a*.

FIG. 7 illustrates the single-ended apparatus 10*a* being loaded into a well counter 28. The well counter 28 typically has a well counter liner 27 that the apparatus 10*a* is set into to allow the hypodermic syringe 25 containing a radiopharmaceutical 26 to be loaded and measured at the well counter 28. The dose applicator 18*a* positions the insert 20 by the insert holder 16*i* and the first telescoping rod 16*h* and the second telescoping rod 16*g*. The well counter liner gap 27*a* is large enough so that the first body second male thread 11*c* can easily fit into the well counter liner 27 allowing the first body 11 to set on top of the well counter liner. In this illustration the second body 12 (FIG. 5) has been removed and the first body 11 is positioned into the well counter liner 27 in the direction of the arrow 31. The nut 15 is extended as the insert 20 rests in the first hollow core 23 to be pushed into the well counter 28 in the direction of the arrow 31.

FIG. 8 illustrates the doubled-ended apparatus 10 with the dose applicator 18*a*. The apparatus 10 transports a hypodermic syringe 25 containing a radiopharmaceutical 26 and protects individuals from radiation generated therefrom. A first body 11 releasably communicates with a second body 12 and the first body 11 releasably communicates with a third body 13. The third body 13 releasably communicates with a nut 15. Attached to the nut 15 is the first telescoping rod 16*h* and the second telescoping rod 16*g* of the dose applicator 18*a*. The first telescoping rod 16*h* is positioned in the first hollow stem 13*l* and sized to allow all of the sections of the first telescoping rod 16*h* to move freely within the first hollow stem 13*l*. Likewise, the second telescoping rod 16*g* is positioned in the second hollow stem 13*k* and sized to allow all of the sections of the second telescoping rod 16*g* to move freely within the second hollow stem 13*k*. Finally, the first connection means 34 releasably secures the first body 11 to the third body 13, the second connection means 33 releasably secures the first body 11 to the second body 12 and the third connection means 35 releasably secures the third body 11 to the nut 15.

The dose applicator is positioned in the first hollow core 23*a*, the second hollow core 23*b* and the third hollow core 23*c*. This allows the hypodermic syringe 25 with the radiopharmaceutical 26 to be positioned inside the insert 20 wherein the insert is releasably secured to the dose applicator 18*a* by the insert holder 16*i*. Radiation leakage around the dose applicator 18*a* is significantly reduced by releasably securing the third body 13 and the nut 15 with the releasable wrap 15*c*. For example, when the nut 15 is not releasably secured by the releasable wrap 15*c* the nut can be moved away from the third body 13 exposing the first hollow stem 13*l* and the second hollow stem 13*k*. When there is radiation emanating from the radiopharmaceutical 26 located in the third hollow core 23*c* the radiation leakage is possible out of the first hollow stem 13*l* and second hollow stem 13*k*. A snug-fit between the third body 13 and nut 15 using the releasable wrap 15*c* as the third connection means 35 prevents this radiation leakage.

FIG. 9 illustrates one view of the preferred embodiment of the invention, including the first body 11 and second body 12 (with the piston actuator 17) of the double-ended apparatus 10 with the hypodermic syringe 25 and the radiopharmaceutical 26 wherein the radiopharmaceutical can be injected into a patient or intravenous delivery system. The first body 11 and second body 12 are the radionuclide shield surrounding the insert 20 and are constructed of various materials including, but not limited to tungsten and lead. The insert holder 16*i* (FIG. 8) has been removed from the first hollow core 23*a* along with the dose applicator 18*a* (FIG. 8). When the radiopharmaceutical 26 is going to be injected into a patient the second section 22 of the insert 20 is removed from the first section 21 at the perforation 21*b*. The piston actuator 17 is partially withdrawn from the second body 12 and the actuator cap 36 is rotated to the engaged position, causing the internal sleeve engagement tooth 37*a* to engage the disk 39, which in turn engages the piston of the syringe 25. This is accomplished without exposing anyone to the radiation emanating from the radiopharmaceutical 26. The hypodermic syringe 25 is ready to be injected into the patient or intravenous delivery system once the needle cover 32 is removed. The radiopharmaceutical 26 is injected by depressing the actuator cap 36 which in turn compresses the syringe 25.

FIG. 10 illustrates the cross-section of the piston actuator 17 used in the double-ended syringe shield apparatus 10 in the preferred embodiment of the invention. The piston actuator 17 communicates with and is slidably secured to the second body 12. The piston actuator 17 is used, for example, to inject the contents of the hypodermic syringe 25 (FIG. 7) into a patient or intravenous tubing.

In the preferred embodiment, the means for compressing includes piston actuator 17 that comprises an actuator cap 36, a disk 39, at least one guide 38, and an internal sleeve 37, having a first arm 37*b*, a second arm 37*c*, a retainer lip 37*d* and an engagement tooth 37*a*. The internal sleeve 37 is a hollow cylinder, sized to allow it to slide within the second hollow core 23*b* without contacting the insert 20 or hypodermic syringe 25. The internal sleeve first arm 37*b* is positioned in the first hollow slot 12*j* and communicates with the actuator cap 36. The internal sleeve second arm 37*c* is positioned in the second hollow slot 12*k* and communicates with the actuator cap 36. The actuator cap 36 and the internal sleeve 37 are fixedly connected. The first hollow slot 12*j* and second hollow slot 12*k* are of sufficient width to allow the internal sleeve arms 37*b* and 37*c* to slide in the hollow slots 12*j* and 12*k*, allowing the internal sleeve 37 to slide longitudinally relative to the second body 12. FIG. 11 illustrates the cross section of the second body 12 with the actuator cap 36 and internal sleeve arms 37*b* and 37*c* extended from the second body 12.

The first hollow slot 12*j* and second hollow slot 12*k* are of sufficient length relative to the width of the internal sleeve arms 37*b* and 37*c* that the actuator cap 36 is capable of rotating less than a full rotation, preferably approximately a quarter rotation, relative to the second body 12. In the preferred embodiment, the limit of rotation of the actuator cap 36 in one direction would be the engaged position and the limit of rotation of the actuator cap 36 in the opposite direction would be the disengaged position.

The disk 39 consists of at least one guide notch 39*a* and at least one engagement notch 39*b*. In the preferred embodiment there are two guide notches 39*a* and two engagement notches 39*b*, corresponding to two guides 38 and two engagement teeth 37*a*. The disk 39 is sized so that it can slide within the internal sleeve 37. The at least one engagement notch 39*b* is slightly larger than the internal sleeve engagement tooth 37*a*. The at least one guide notch 39*a* is approximately the same size as the diameter of the at least one guide 38. The at least one guide 38 is fixedly attached to the inside of the second body 12, opposite the second body second surface 12*d* and extends to the second body first surface 12*e*. The at least one guide notch 39*a* slidably communicates with the at least one guide 38, allowing the disk 39 to slide within the internal sleeve 37. The at least one guide 38 prevents the disk 39 from rotating relative to the second body 12. The internal sleeve retainer lip 37*d,* retains the disk 39 inside of the internal sleeve.

The internal sleeve engagement tooth 37*a* is positioned on the inside surface of the internal sleeve 37. The location of the internal sleeve engagement tooth is selected such that depressing the actuator cap when it is in the engaged position will completely compress the syringe piston into the syringe 25. The internal sleeve engagement tooth must be of sufficient size that it will engage the disk 39 when the disk 39 slides within the internal sleeve 37. The disk engagement notch 39*b* is positioned such that when the actuator cap 36 is rotated to the disengaged position and is extended from the second body, the internal sleeve engagement tooth 37*a* passes through the engagement notch 39*a*.

When the actuator cap 36 is then rotated to the engaged position and compressed into the second body 12, the disk engagement notch 39*b* engages the disk 39 and causes the disk 39 to engage the piston of a syringe 25 contained within the double ended syringe shield apparatus 10. The actuator cap 36 is usually sized to the same diameter as the diameter of the second body 12 at the second body second edge 12*d*.

While there has been illustrated and described what is at present considered to be the preferred embodiment of the invention, it should be appreciated that numerous changes and modifications are likely to occur to those skilled in the art. It is intended in the appended claims to cover all those changes and modifications that fall within the spirit and scope of the present invention.

What is claimed is:

1. An apparatus that acts as a shield for radiopharmaceuticals and protects from radioactivity comprising:

a) a first body with a first hollow core that is open on a first edge and a second edge of said first body, said first hollow core for housing a hypodermic syringe;

b) a second body with a second hollow core that is open on a first edge of said second body, said second hollow core for housing said hypodermic syringe;

c) a third body with a third hollow core that is open on a first edge of said third body, said third hollow core for housing said hypodermic syringe;

d) said hypodermic syringe capable of containing a radiopharmaceutical;

e) a first connection means wherein said first body releasably communicates with said second body for providing protection from radioactivity emitted by the radiopharmaceutical;

f) a second connection means wherein said first body releasably communicates with said third body for providing protection from said radioactivity; and g) said second body further comprising a means for compressing said hypodermic syringe to eject said radiopharmaceutical from the hypodermic syringe while said first body is in communication with said second body.

2. The apparatus as claimed in claim 1 wherein said first body, second body and third body are constructed from a plurality of radiation shielding materials.

3. The apparatus as claimed in claim 1 wherein said means for compressing said hypodermic syringe comprises:

a) an internal sleeve, slidably and rotatably communicating with the interior surface of said second body and capable of partially extending outside of said second body through slots formed in said second body's second edge;

b) at least one disk guide inside said second body and parallel to the long axis of said second body and extending the length of said second body;

c) an actuator cap fixedly attached to said internal sleeve and positioned to block said radiation emitted from the second edge of said second body, said actuator cap engaged by said at least one disk guide;

d) a disk having an at least one guide notch in slidable communication with said at least one disk guide such that the disk is prevented from rotating relative to said second body;

e) said disk further having at least one engagement notch;

f) at least one disk engagement tooth on the inside surface of said internal sleeve, said tooth positioned such that when the internal sleeve is selectively rotated to a position, said internal sleeve can be extended from and retracted into said second body without bringing said at least one engagement tooth into communication with the disk and when the internal sleeve is selectively rotated to any other position said at least one engagement tooth engages the disk when the actuator cap is compressed;

g) wherein said at least one engagement notch is sized slightly larger than said at least one disk engagement tooth.

4. The apparatus as claimed in claim 1 wherein said means for compressing compresses said hypodermic syringe by being partially extended from said second body, selectively rotated relative to said second body and then compressed into said second body.

5. The apparatus as claimed in claim 1 wherein said first connection means and said second connection means are selected from the group consisting of threaded connection, locking nut and compression flange.

6. The apparatus as claimed in claim 1 wherein said third body is removed from said first body, permitting operation of said means for compressing to compress said hypodermic syringe to eject said radiopharmaceutical from the hypodermic syringe, while providing protection from said radiation.

7. The apparatus as claimed in claim 1 wherein said hypodermic syringe is housed in an insert.

8. The apparatus as claimed in claim 7 wherein said insert further comprises a first section and a second section wherein said second section is detachable from said first section.

9. An apparatus that acts as a shield for radiopharmaceuticals and protects individuals from radioactivity comprising:

a) a first body with a first hollow core that is open on a first edge and a second edge of said first body, said first hollow core for housing a hypodermic syringe;

b) a second body with a second hollow core that is open on a first edge of said second body, said second hollow core for housing said hypodermic syringe;

c) a third body with a third hollow core that is open on a first edge of said third body, said third hollow core for housing said hypodermic syringe;

d) said hypodermic syringe capable of containing a radiopharmaceutical;

e) a first connection means wherein said first body releasably communicates with said second body for providing protection from radioactivity emitted by the radiopharmaceutical;

f) a second connection means wherein said first body releasably communicates with said third body for providing protection from said radioactivity;

g) said third body further comprising means for extending said hypodermic syringe from said first and third bodies to permit measurement of said radiopharmaceutical in said hypodermic syringe and providing protection from said radioactivity; and h) said second body further comprising means for compressing said hypodermic syringe to eject said radiopharmaceutical from the hypodermic syringe while said first body is in communication with said second body.

10. The apparatus as claimed in claim 9 wherein said first body, second body and third body are constructed from a plurality of radiation shielding materials.

11. The apparatus as claimed in claim 9 wherein said means for extending comprises two rod connectors and means to securely fasten said rod connectors to said hypodermic syringe.

12. The apparatus as claimed in claim 9 wherein said means for extending comprises a chain.

13. The apparatus as claimed in claim 9 wherein said means for extending comprises a cable.

14. The apparatus as claimed in claim 9 wherein said hypodermic syringe is housed in insert.

15. The apparatus as claimed in claim 14 wherein said insert further comprises a first section and a second section, wherein said second section is detachable from said first section.

16. The apparatus as claimed in claim 9 wherein said second body is removable from said first body allowing said radiopharmaceutical in said hypodermic syringe to be measured in a well counter.

17. The apparatus as claimed in claim 9 wherein said third body is removable from said first body for said individual to manipulate said hypodermic syringe to inject a patient with said radiopharmaceuticals and be protected from said radiation.

18. The apparatus as claimed in claim 9 wherein said means for compressing said hypodermic syringe comprises:

a) an internal sleeve, slidably and rotatably communicating with the interior surface of said second body and capable of partially extending outside of said second body through slots formed in said second body's second edge;

b) at least one disk guide inside said second body and parallel to the long axis of said second body and extending the length of said second body;

c) an actuator cap fixedly attached to said internal sleeve and positioned to block said radiation emitted from the second edge of said second body, said actuator cap engaged by said at least one disk guide;

d) a disk having an at least one guide notch in slidable communication with said at least one disk guide such that the disk is prevented from rotating relative to said second body;

e) said disk further having at least one engagement notch;

f) at least one disk engagement tooth on the inside surface of said internal sleeve, said tooth positioned such that when the internal sleeve is selectively rotated to a position, said internal sleeve can be extended from and retracted into said second body without bringing said at least one engagement tooth into communication with the disk and when the internal sleeve is selectively rotated to any other position said at least one engagement tooth engages the disk when the actuator cap is compressed;

g) wherein said at least one engagement notch is sized slightly larger than said at least one engagement tooth.

* * * * *